US005778497A

United States Patent [19]

Noda

[11] Patent Number: 5,778,497

[45] Date of Patent: Jul. 14, 1998

[54] PLASTIC CLIP

[75] Inventor: Taizo Noda, Nishinomiya, Japan

[73] Assignee: J-Sen Ltd. No. 32, Kyoto, Japan

[21] Appl. No.: 820,346

[22] Filed: Mar. 12, 1997

[30] Foreign Application Priority Data

Mar. 25, 1996 [JP] Japan ..... 8-095973

[51] Int. Cl.[6] ..... A44B 21/00

[52] U.S. Cl. ..... 24/504; 24/499

[58] Field of Search ..... 24/499, 503, 504, 24/575, 576

[56] References Cited

U.S. PATENT DOCUMENTS 5,400,483 3/1995 Noda .

FOREIGN PATENT DOCUMENTS 53-20900 6/1978 Japan .

*Primary Examiner*—James R. Brittain

*Attorney, Agent, or Firm*—Ronald R. Snider

[57] ABSTRACT

A plastic clip for use clothes such as a sudpender clip, kimono, or clohespin, has an all plastic three-part design incorporating an over center clipping action dependent upon the resiliency of plastic materials, and incorporates no metallic spring. An upper clipping member has a spindle plate established between side walls, and a pair of recess bearings on inner faces of the side walls. A lower clipping member has a ditch like bearing which engages the spindle plate of the upper clipping member, a projection which is narrower than protuberances formed on the sides of the projection, and an elastic tongue prepared on a central portion just under the projection which extends upward. The third portion of the clip is an operation stick having a box with outer walls which is established to be inserted between upper clipping member side walls and the lower clipping member projection. The operation stick member also has a pair of actuation expansions on the out side of the box outer wall while both inner sides of the box have a pair of engaging dents into which protuberances of the lower clipping member are fitted in. A pressure plate of the operation stick member is established hehind the center of the actuator expansions and a slit-like belt insertion is prepared at the rear end of the operation.

5 Claims, 8 Drawing Sheets

PLASTIC CLIP

RELATED APPLICATIONS

The present disclosure relates to subject matter contained in Japanese Patent Application Number 8-095973 (filed on Mar. 25, 1996) which is expressly incorporation herein by reference in its entirety.

BACKGROUND OF THE INVENTION

The present invention relates to a plastic clip, for example, a clip used on clothes such as a suspender clipper or a clip attached to the leading end of a waist-cloth for closing a Kimono, or clothespin.

The present inventor has developed various kinds of plastic clips for practical use, and he has already obtained U.S. Pat. No. 5400483.

A typical example of the present plastic clip was disclosed in Japanese Patent Publication No. 53-20900 by the inventor of the present application. Based on this prior art, he has pioneered a new device which is this invention.

This prior art is now explained in detail, by referring to FIG. 8 and FIG. 9.

FIG. 8A shows an upper clipping member (A) having an upper substrate (2) with a pair of side walls (1) and a mouth (3) in rectangle shape which is formed on the substrate (2) in the rear, having a bearing (4) to accept an operation stick member (C) which is established on inner faces of both walls (1), and having the walls (1) defining a half and lower portion of said mouth (3) in which a spindle plate (5) with an arcuate roof is formed.

FIG. 8C shows a lower clipping member (B) having a lower substrate (10) adapted to be inserted between the front end of the mouth (3) and the spindle plate (5), and at one end of the substrate (10) a bulging portion (11) which is formed in the same width of the substrate (10), while showing on the back side of the bulging portion (11) a ditch-like bearing (12) which is prepared to engage with said spindle plate (5), and at the rear end of the portion (11) a projection (13) which is formed in narrower width than the portion (11) and the projection (13) which does not reach to the rear end of said mouth (3), and showing a semicircular protuberance (14) which is also formed on the projection (13) with a slight gap between the outer side of the projection (13) and the side walls (1).

FIG. 8B shows the operation stick member (C) having an operation substrate (2 0), on one end of which a box (21) without a forward wall and a bottom is formed so that the projection (13) and the semicircular protuberance (14) can be engaged between the projection (13) and the rear end of the mouth (3) from the underside. On both outer walls (22) of the box (21) a pair of actuation expansions (23) are prepared so that this expansion (23) can engage freely with said bearing (4), while on the top of inner surface of the box (21) a fan-like protrusion (24) is formed in order that the protrusion (24) can collaborate with the semicircular protrubrance (14) in mutual semicircular movement.

The clip in prior art comprises said three main components, and in order to keep the upper member (A) and the lower member (B) in the open, a separate metallic spring (30) is fitted into two spring ditches (6) (16) established on said both members (A) (B) respectively.

In order to complete the clip, a rear portion of the lower member (B) is thrust out through the mouth (3) of the upper member (A), and just above the spindle plate (5) of the upper member (A) where the ditch-like bearing (12) of the lower member (B) is engaged. At the same time, as shown in FIG. 9A, a front portion of the operation stick member (C) is forcibly thrust into the lower portion of the mouth (3) until the front portion comes out through the mouth (3), while the protrusion (24) located at the tip of the operation member (C) rides on the semicircular protuberance (14) located at the rear end of the lower member (B).

When the operation member (C) is assembled, it must be inserted forcibly into contacting portions of the upper member (A) and the lower member (B) against the force caused by elasticity of the plastic materials as of both members (A) (B) where are devised to interfere. However, once this assembly is complete, the operation member (C) is ensured not to slip out.

Accordingly, when the operation member (C) is moved into the condition shown in FIG. 9C from the condition shown in FIG. 9B, both front portions of the upper and lower members (A) (B) are kept open by function of the metal spring (30).

In order to pinch thin materials like cloth, as shown in FIG. 9A, the operation member (C) is moved in parallel with the clip, wherein, showing in FIGS. 9C, 9B and 9A, the arcuate surface of the semicircular protuberance (14) is gradually pushed down in friction with the arcuate surface of the fan-like protrusion (24) of the operation member (C) and finally both the protuberance (14) and the protrusion (24) are aligned with each other shown in FIG. 9A. Thus, the assembled clip produced by the upper member (A), the lower member (B) and the operation member (C) has almost smooth surfaces on both upper and lower faces.

The prior art clip has the following defects: One is that it is indispensable to adopt the metal spring (30) as its component. The other is that the locking condition as shown in FIG. 9A is not stable, because direction of pressure force in the locking condition empowered on the operation member (C), the upper member (A) and the lower member (C) is not imposed in the correct facing condition.

As shown in FIG. 9A, the pressure force imposed on the clip is indicated as marks (▲). The locking force between the upper member (A) and the lower member (B) is caused at a contacting point (a) of the spindle plate (5) and the ditch-like bearing (12), the same force between the lower member (B) and the operation member (C) at a contacting point (b) of the protuberance (14) and the protorusion (14), while the similar forces between the upper member (A) and the operation member (C) are caused at two contacting points (c) (d), one point of the actuated expansion (23) and the bearing (4), the other of a rear end of the mouth (3) and the rear surface of the box (21) respectively. The locking condition is maintained with these four points (a) (b) (c) (d).

The direction of each pressure power shown at the contacting points (a) (b) (c) (d) does not face in correct direction with respect with a tangential line supplied by the turning movement of the lower member (B) centering around the spindle plate (5). This direction deviates at 45 degree angle. Therefore, an effective locking is not obtained , and it sometimes leads to the unstable status when fitting the operation member (C) into the upper member (A) correctly. Thus when this clip pinches thick material therebetween the op(ration member (C) tends to be slip out.

Further, as the bulging portion (11) of the lower member (B) and the upper surface of the box (21) of the operation member (C) are exposed from the mouth (3) of the upper member (A), in the present technology it is very difficult to prepare these three members at the exact height for smooth surface when the clip is closed.

SUMMARY OF THE INVENTION

This invention has an object to provide a clip capable of attaining a required performance, without using any metal spring, by utilizing the elasticity of a plastic material itself.

The present invention has another object to provide a plastic clip that constitutes three parts which are an upper clipping member, a lower clipping member and an operation stick member.

The invention has another object to provide a plastic clip in its minimum size wherein the lower member and the operation member are built in the same thickness as the upper member.

The invention has a further object to provide a plastic clip which is equipped with the proper clipping force and with the proper locking force.

In order to realize said objects, this inventor has adopted the following constructions.

A plastic clip having an upper clipping member (A), a lower clipping member (B) and an operation stick member (C), the clip comprising:

an upper clipping member (A) in which all parts and elements are constructed as one integral body, having an upper substrate (2), on a rear portion of which a mouth (3) is built in a square shape, a pair of side walls (1) formed in both sides of the mouth (3), on the front and lower side of each wall (1) a spindle plate (5) in an arcuate shape being bridged between the side walls (1) while a pair of recess bearings (4) which accept the operation member (C) are formed on an inside surface of the walls (1) at a distance from the spindle plate (5);

a lower clipping member (B) in which all parts and elements are constructed as one integral body, having a lower substrate (10), wherein its rear portion is formed narrower in size than its front portion so that this narrower rear portion is insertable between a front end of the mouth (3) and the spindle plate (5), having a ditch-like bearing (12) being formed to be freely movable over the spindle plate (5) on the rear and lower portion of the upper substrate (2), having a projection (13) formed in its rear end with a pair of protuberances (14*a*) established on both sides of the lower substrate (10), said projection (13) not reaching the rear end of the mouth (3) and being narrower than the rear portion of the lower substrate (10), and having an elastic tongue (30*a*) extending upward between a pair of a U-letter like notches (16*a*); and an operation stick member (C) in which all parts and elements are constructed as one integral body, having an operation substrate (20), having on one end a box (21) without a front wall and a bottom defined by a pair of outer side walls (22) with a thickness adapted to be inserted between a rear end of the mouth (3) and a rear end of the projection (13) and also adapted to be insertable between inner surface of the upper clipping member side walls (1) and outer surface of the lower clipping member projection (13) from the lower side of the mouth (3), having a pair of actuation expansions (23) which freely engage with a pair of recess bearings (4) on outer surface of a pair of outer side walls (22), having a pair of engaging dents (26) which are fitted with the protuberances (14*a*) formed on a lower and inner surface of outer side walls (22), having a pressure plate (24*a*) which contacts on upper surface of the projection (13) being established a little bit behind the center of actuation expansions (23) in the box (21), and having a slit-like belt insertion (25) drilled on another end of the operation substrate (10).

In addition, a recess (18) is formed in a center of the projection (13) at the end of the lower clipping member (B) and a pressure plate (24*a*) with a slope (24*b*) established in an upper and inner surface of the box (21) built into the operation stick member (C), and the pressure plate (24*a*) has its width adapted to be fitted into the recess (18).

DETAILED DESCRIPTION OF PREFERRED EMBODIMENT

Figure 1A:
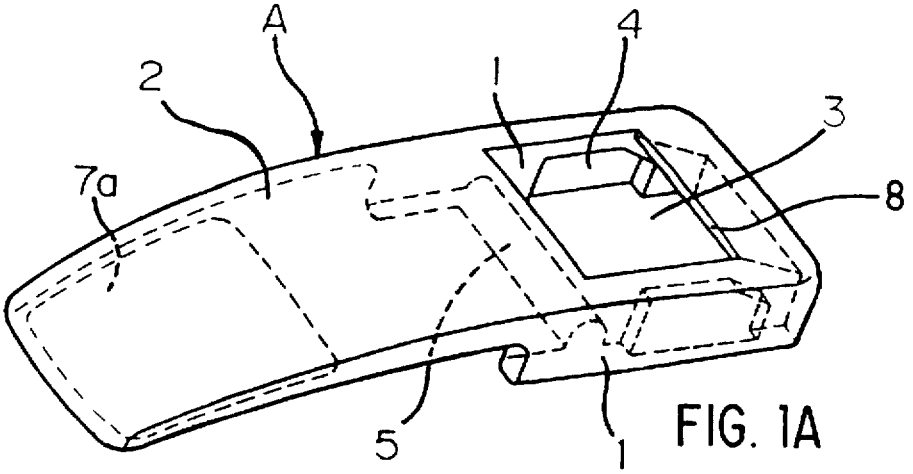
FIG. 1A shows an upper clipping member of this invention.
Figure 1B:
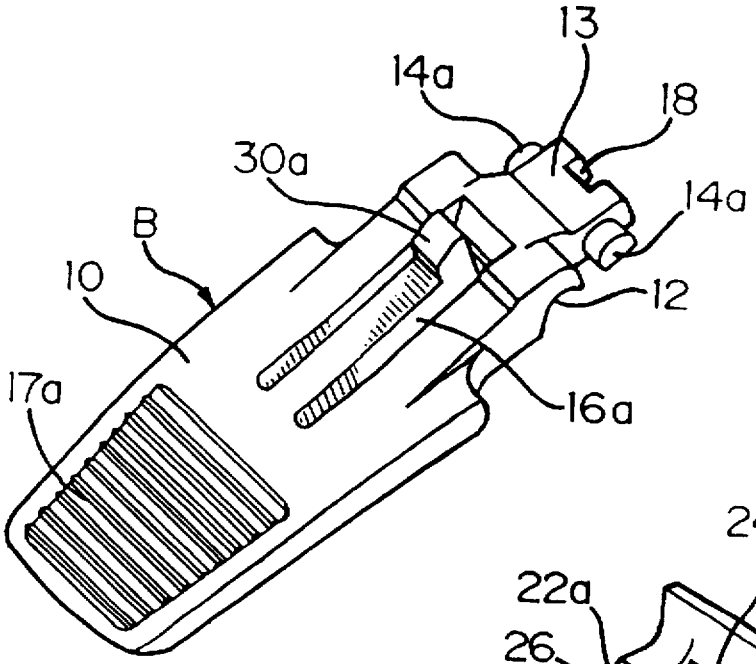
FIG. 1B shows a lower clipping member of this invention.
Figure 1C:
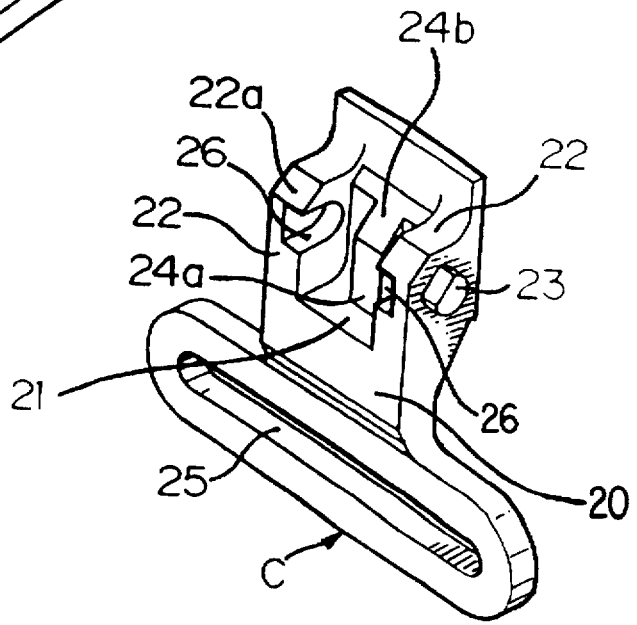
FIG. 1C shows an operation stick member of this invention.

FIG. 1A, 1B and 1C show an exploded view of a plastic clip of this invention, an upper clipping member (A), a lower clipping member (B) and an operation stick member (C) are represented.

The upper member (A) shown in FIG. 1A has an upper substrate (2), on which the rear portion of a mouth (3) is prepared in a square shape. A pair of side walls (1) is formed in the both sides of the mouth (3), and on the front and lower side of the wall (1) a spindle plate (5) in an arcuate shape is bridged between both side walls (1) while on the walls (1) a pair of recess bearings (4) is formed a little distance from the spindle plate (5) to accept the operation member (C). The numeral 7*a* is a ragged surface clipping portion, while the numeral 8 is a recess window prepared at the rear portion.

The lower member (B) shown in FIG. 1B has an lower substrate (10), wherein the rear portion is formed in narrower size than the front portion so that this narrow portion can be inserted between the front end of said mouth (3) and the spindle plate (5). On the rear and lower portion of the substrate (10) a ditch-like bearing (12) is formed to be freely movable over the spindle plate (5). On the both sides of the substrate (10) at its rear end a pair of protrubrances (14*a*) are established, and a projection (13) which is far narrower than the rear portion of the substrate (10) and not reaching at the rear end of the mouth (3) is formed. A pair of U-letter like notches (16*a*) are prepared and an elastic tongue (30*a*)

extending upward is also prepared therebetween. All of these explained parts are the integral unity of the lower member (B). The numeral 17*a* is the clipping teeth prepared on the front side of the member (B), while the numeral 18 is a hollow prepared on the central end of the projection (13).

The operation stick member (C) shown in FIG. 1C has an operation substrate (20), on the one end of which a box (21), which is formed without a front wall and a bottom, is established surrounded by a pair of outer side walls (22) fixed with chamfering bevelings (22*a*). These outer walls (22) have their thickness adapted to be inserted between the rear end of the mouth (3) and the rear end of the projection (13) from the lower side of the mouth (3). A pair of actuation expansions (23) which are freely engaging into the recess bearing (4) are prepared on the outer side wall (22), while an engaging dent (26) into which the protuberance (14*a*) is fitted, is formed. A pressure plate (24*a*) is prepared a little bit behind the expansion (23), and the plate (24*a*) contact on the upper surface of the projection (13). The plate (24*a*) is equipped with a slope (24*b*) so that it is adapted to fit into the hollow (18) in the upper inside of the box (21). At the same time, a slit-like belt insertion (25) is drilled at the other end of the operation substrate (20).

Figure 2:
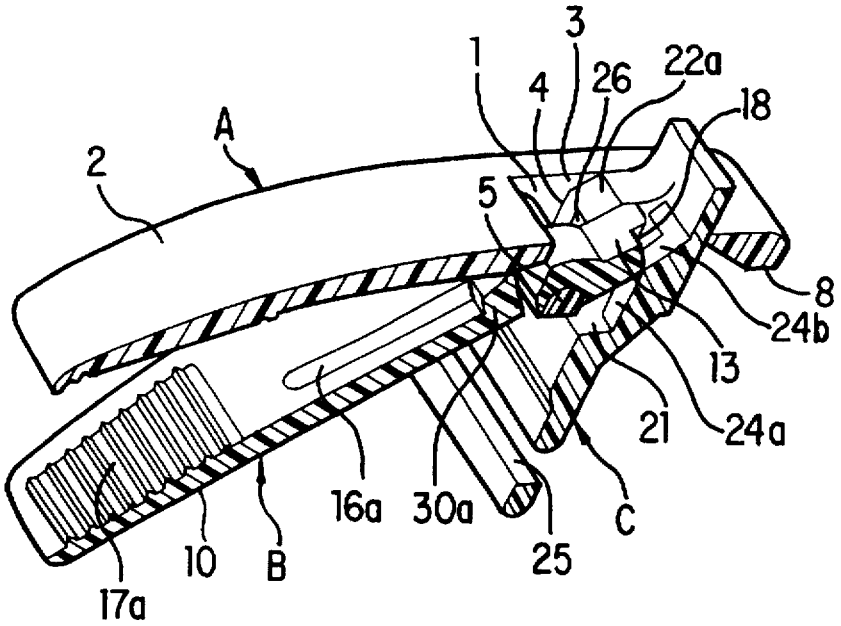
FIG. 2 is a vertical and perspective section showing a condition when the clip is opened.

The upper member (A), the lower member (B) and the operation member (C) are made of elastic and flexible plastic, and they are assembled as shown in FIG. 2.

Figure 3:
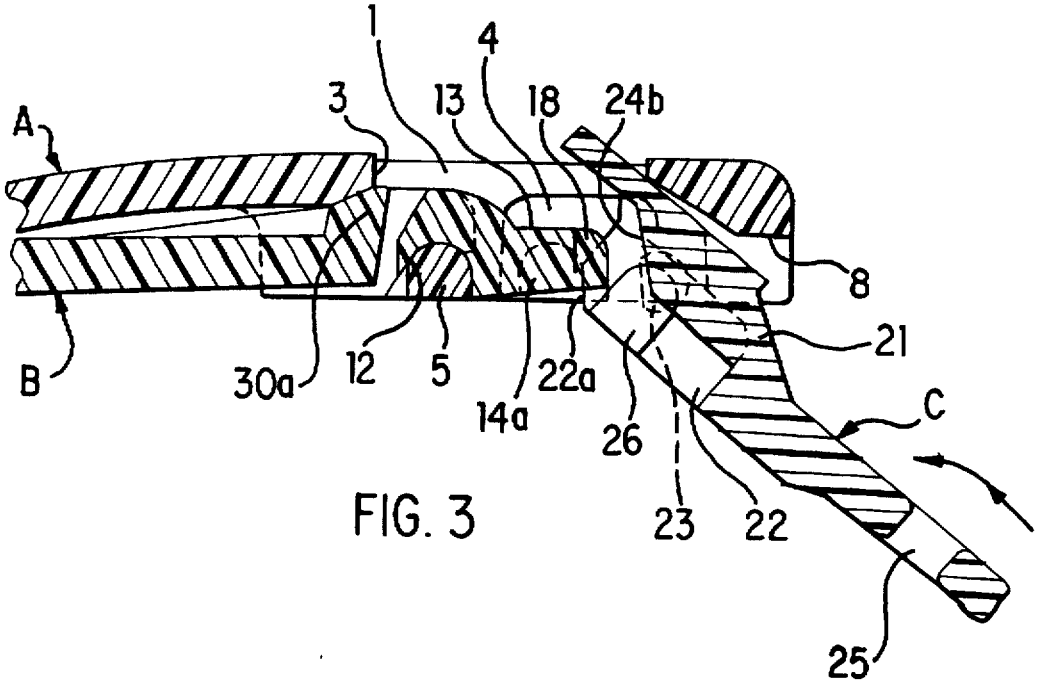
FIG. 3 is a sectional side elevation showing a condition when the operation stick member is inserted.

As shown in FIG. 3, the rear end of the lower member (B) and the mouth (3) of the upper member (A) ire adapted to interfere each other and not accept the front end of the operation member (C) therebetween until the operation member is correctly assembled. In other words, this interference is caused where the protuberance (14*a*) contacts the chamfering beveling (22*a*) when the front end of the operation member (C) is inserted from the lower side of the mouth (3).

Now, the assembling procedures are explained. With reference to FIG. 2, the rear end of the lower member (B) is inserted from the lower side of the mouth (3) as the ditch-like bearing (12) is exactly aligned on the spindle plate (5). Then, with reference to FIG. 3, in the condition that the both clipping members (A) (B) are closed in parallel, the actuation expansion (23) is engaged in the recess bearing (4) and the front end of the operation member (C) is inserted into the mouth (3) from the lower side and is pushed upward slantwise. Further the rear portion of the operation member (C) is forcibly pushed upward slantwise and rotatively as shown the Arrow mark of FIG. 3. Thus, the protuberance (14*a*) slides along the chamfering beveling (22*a*) and thus the interference portion becomes flexible against the elastic force between the rear part of the protuberance (14*a*) and the outer wall (22). Finally, as shown in FIG. 4 and FIG. 5, the protuberance (14*a*) is fitted into the engaging dent (26) to provide the completion of the present clip.

Figure 4:
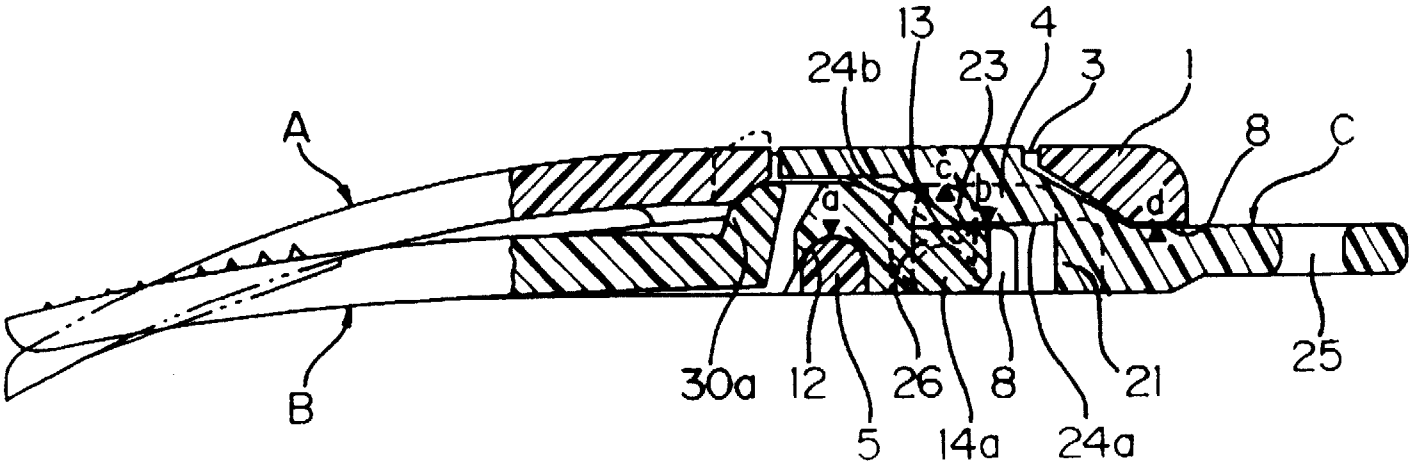
FIG. 4 is a sectional side elevation showing a condition when the clip is closed.
Figure 5:
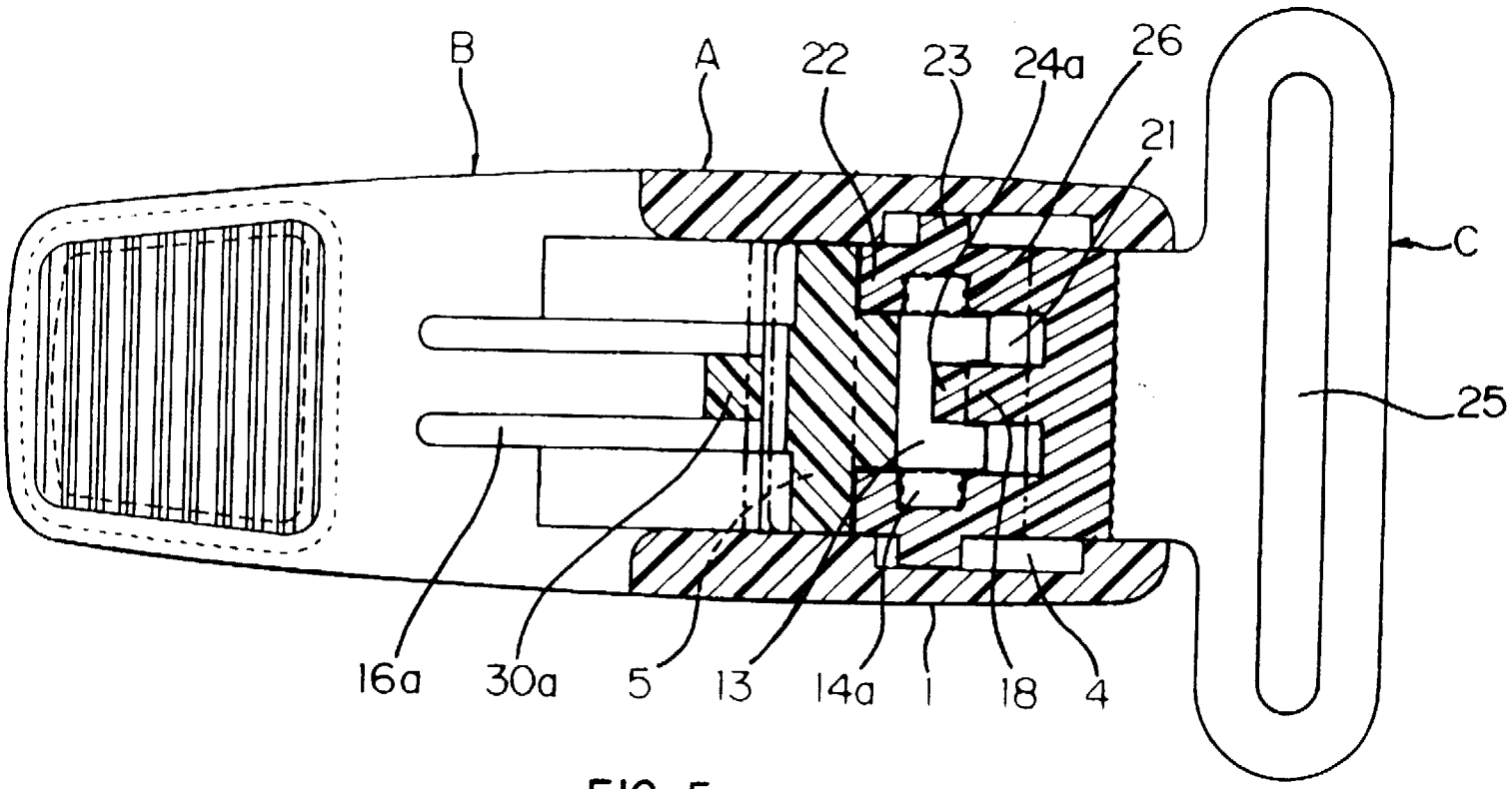
FIG. 5 is a sectional top plan view showing a condition when the clip is closed.
Figure 6A:
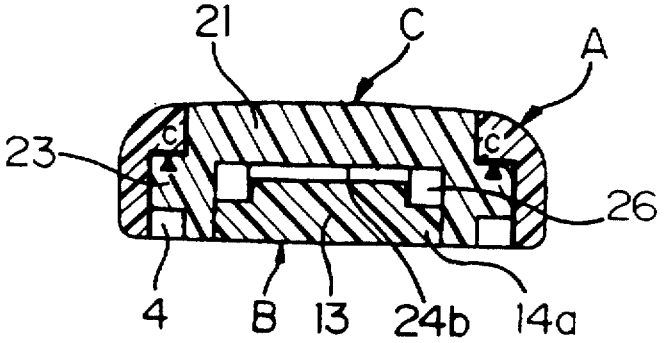
FIG. 6A shows the upper clipping member of this invention.
Figure 6B:
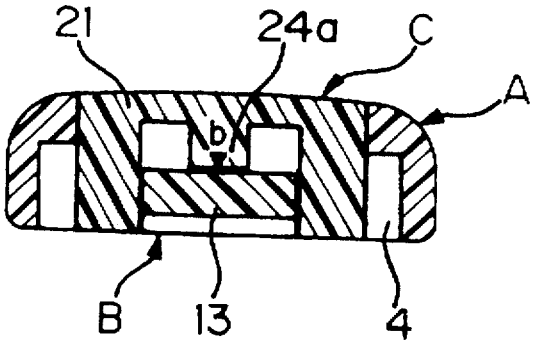
FIG. 6B shows a sectional view of the clip when closed with pressure point "b".

FIG. 4 indicates a closed condition of the clip, where the upper portion of the ditch-like bearing (12) contacts and presses on the upper face of the spindle plate (5) at the point (a), while the upper face of the projection (13) contacts and presses on the lower face of the pressure plate (24*a*) at the point (b), so that these contacts produce the closing condition for the clipping members (A) (B). The details of this (b) contacting point are shown in FIG. 6B.

During the above procedure when closed, the upper portion of the expansion (23) contacts and presses on the upper wall of the recess bearing (4) on the point (c) in the middle position of the pressure plate (4). The details of this contacting point (c) are shown in FIG. 6A. At the same time, the rear and upper surface of the operation member (C) contacts and presses on the surface of the recess window (8) at the point (d) shown in FIG. 4, so that this contact receives the reaction force caused by the two clipping members (A) (B). All contacts explained so far are devised to almost face with respect to a tangential line supplied by the circular movement around the center of the spindle plate (5). The position of the point (c) is located just between the points (a) and (b) which provides the ensured locking for the lower member (B).

As shown in FIG. 4, the front portions of the two clipping members (A) (B) cross each other on the clip top end, and this crossing force is the clipping force thereof.

Figure 7:
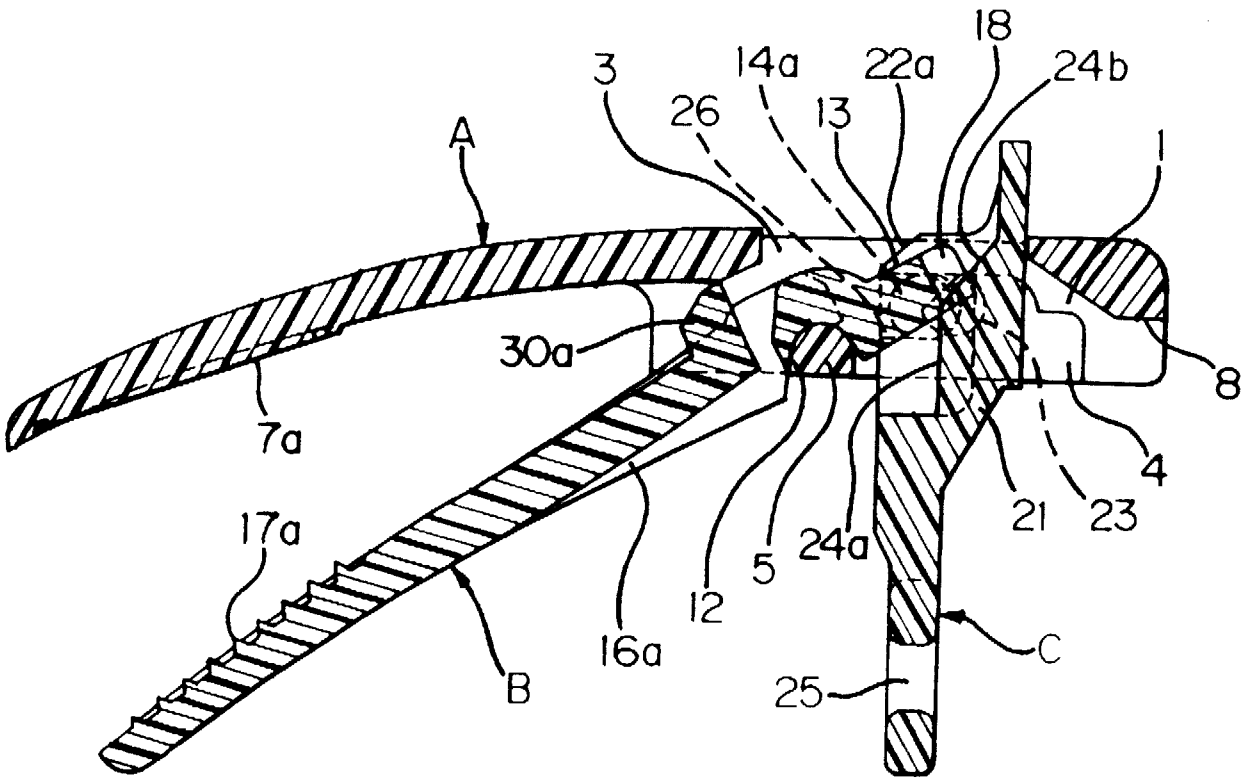
FIG. 7 is a sectional side elevation showing a condition when the clip is opened.
Figure 8A:
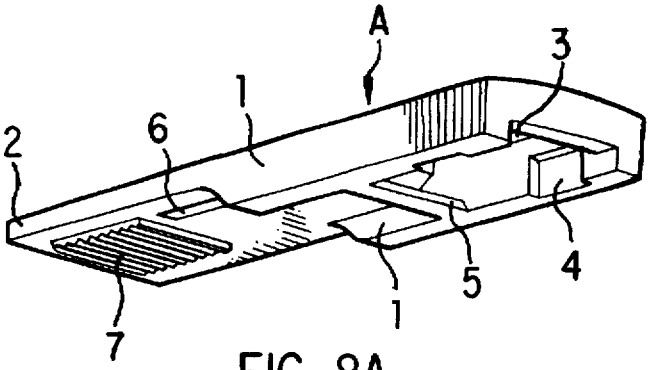
FIG. 8A PRIOR ART
FIG. 8A shows a top member of a prior art clip.
Figure 8B:
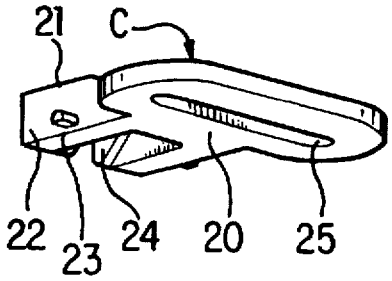
FIG. 8B PRIOR ART
FIG. 8B shows an actuation member of a prior art clip.
Figure 8C:
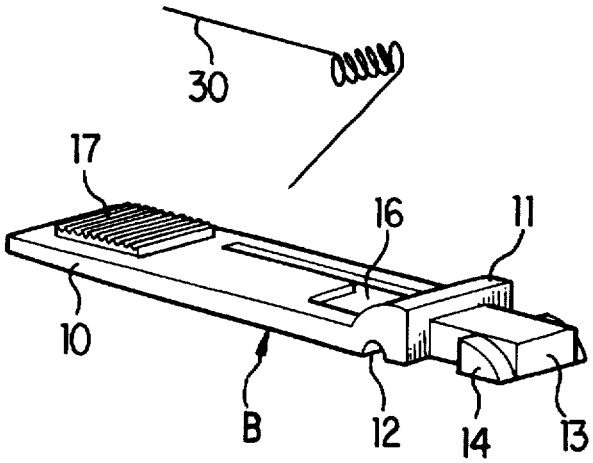
FIG. 8C PRIOR ART
FIG. 8C shows a bottom member of a prior art clip.
Figure 9A:
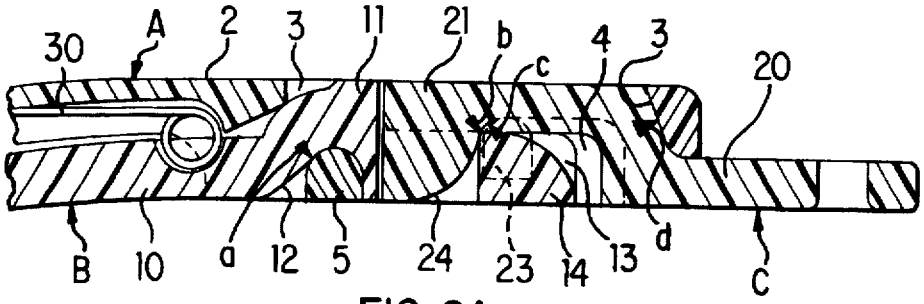
FIG. 9A PRIOR ART
FIG. 9A shows the prior art clip in a closed condition.
Figure 9B:
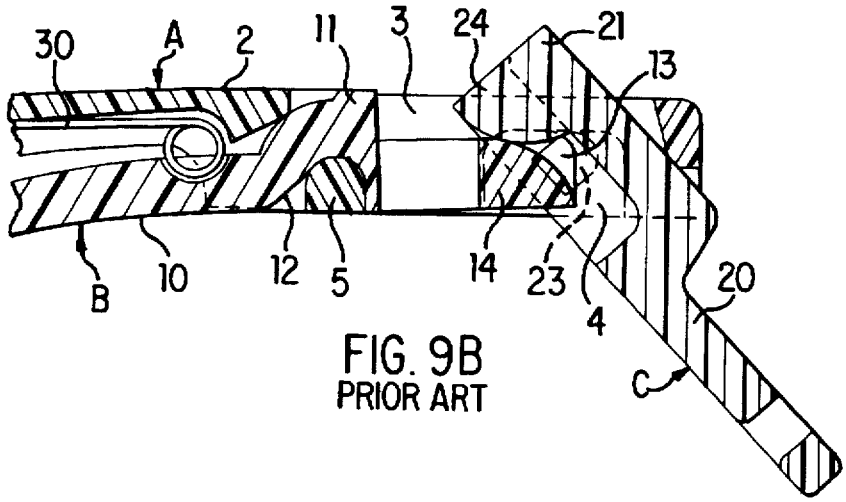
FIG. 9B PRIOR ART
FIG. 9B shows the prior art clip in the partially open position.
Figure 9C:
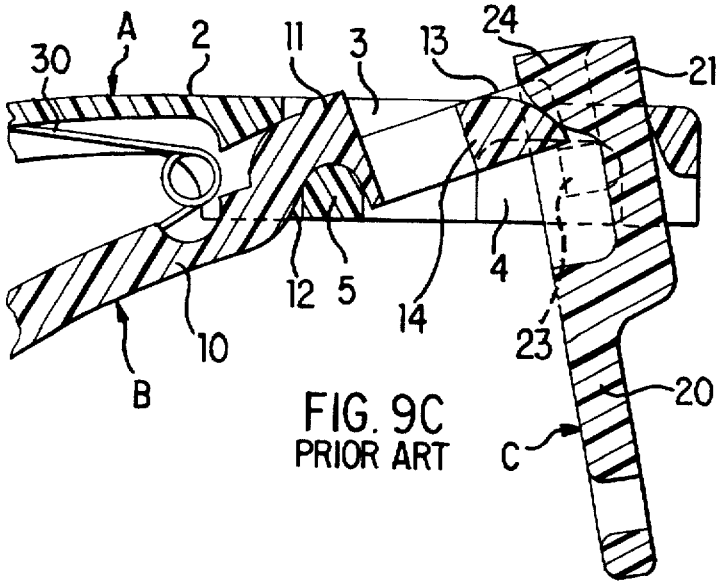
FIG. 9C PRIOR ART
FIG. 9C shows the prior art clip in the fully open position.

In order to loosen from the clipped condition, as shown in FIG. 7, the operation member (C) is now erected vertically. Then, the pressured uniting of the projection (13) is cleared, and then the front portions of the clipping members (A) (B) are separated by the operation of the elastic tongue (30*a*).

The clip developed by the present invention ensures tight locking for the assembled components, and once they are assembled they are never disassembled unintentionaly, since the protrubrance (14*a*) is forcibly fitted into the engaging dent (26) under the function of plastic elasticity. As shown in FIG. 7, even if the operation member (C) is erected vertically, the assembly is still ensured because the expansion (23) is also tightly fitted into the recess bearing (4).

The present embodiment shows the recess built on the center of the projection (13) in the lower member (B) and the pressure plate (24*a*) prepared with a slope (24*b*) to be fitted into said recess (18) in the upper and inner surface of the box (21) as an integral component of the operation member (C). These two parts (24*a*) (24*b*) provide the length of the clip as short as possible. The operation member (C) can be easily assembled into the two clipping members (A) (B). The operation member (C) is smoothly guided into the members (A) (B) without any vibration at all during assembling procedure. Thus, these parts, the recess (24*b*) and the pressure plate (24*a*) are not always necessary, and the upper wall of the box (21) can be used as the pressure plate instead.

The chamfering beveling (22*a*) on the outer wall (22) in the operation member (C) is not always necessary, and if this beveling is not adopted, the protuberance (14*a*) is to be devised to fit smoothly into the engaging dent (26) against the pressure force of plastic elasticity during the assembly procedure.

This invention provides a plastic clip without adopting metal spring therein, and the role of the metal spring is fulfilled by the plastic elasticity and flexibility, while the clip itself is produced in a minimum thin size since the lower clipping member and the operation stick member are both stored into the upper clipping member.

When the clip is closed, the direction of each pressure force and the location of the contacting point are adapted to define in required positions, so that the desirable locking is obtained and ensured. The contacting point (c) between the upper clipping member and the operation member situates almost just in the middle for the contacting point (a) between the spindle plate and the ditch-like bearing and for the contacting point (b) between the lower clipping member and the operation member, and moreover each pressure force faces the other in a tangential line therebetween.

Accordingly, the present invention provides a comfortable clip to the user when he or she is wearing a Japanese kimono, since the clip is very thin and has a smooth surface both in the front and back sides.

It is further understood by those skilled in the art that the foregoing description is a preferred embodiment of the disclosed device and that various changes and modifications may be made in the invention without departing from the spirit and scope thereof.

What is claimed is:

1. A plastic clip having an upper clipping member, a lower clipping member, and an operation stick member, the clip comprising:

an upper clipping member having an upper substrate, on a rear portion of which a mouth is built in a square shape, a pair of side walls formed in both sides of the mouth, on the front and lower side of each wall a spindle plate in an arcuate shape being bridged between the side walls while a pair of recess bearings which accept the operation member are formed on an inside surface of the walls at a distance from the spindle plate;

a lower clipping member having a lower substrate, wherein its rear portion is formed narrower in size than its front portion so that this narrower rear portion is insertable between a front end of the mouth and the spindle plate, having a ditch-shaped bearing being formed to be freely movable over the spindle plate on the rear and lower portion of the upper substrate, having a projection formed in its rear end with a pair of protuberances established on both sides of the lower substrate, said projection extending towards the rear end of the mouth and being narrower than the rear portion of the lower substrate, and having an elastic tongue extending upward between legs a pair of a U-letter shaped opening for separating front portions of the upper and lower clipping members and an operation stick member having an operation substrate, having on one end a box defined by a pair of outer side walls with a thickness adapted to be inserted between a rear end of the mouth and a rear end of the projection and also adapted to be insertable between inner surface of the upper clipping member side walls and outer surface of the lower clipping member projection from the lower side of the mouth, having a pair of actuation expansions which freely engage with the pair of recess bearings on the outer surface of a pair of outer side walls, having a pair of engaging dents which are fitted with the protuberances formed on a lower and inner surface of outer side walls, having a pressure plate which contacts on upper surface of the projection being established behind the center of the actuation expansions in the box, and having a slit shaped belt insertion drilled on another end of the operation substrate.

2. A clip according to claim 1, wherein a recess is formed in a center of a projection at the end of the lower clipping member and a pressure plate with a slope established in an upper and inner surface of the box built into the operation stick member, and the pressure plate has its width adapted to be fitted into the recess.

3. A clip according to claim 1, wherein the upper clipping member is constructed as one integral body.

4. A clip according to claim 1, wherein the lower clipping member is constructed as one integral body.

5. A clip according to claim 1, wherein the operation stick member is constructed as one integral body.

* * * * *